United States Patent [19]

Durenec

[11] 4,409,793

[45] Oct. 18, 1983

[54] DUAL PNEUMATIC VOLUME FOR CRYOGENIC COOLER

[75] Inventor: Peter Durenec, Annandale, Va.

[73] Assignee: The United States of America as represented by the Secretary of the Army, Washington, D.C.

[21] Appl. No.: 369,775

[22] Filed: Apr. 19, 1982

[51] Int. Cl.[3] ..... F25B 9/00

[52] U.S. Cl. ..... 62/6; 60/520

[58] Field of Search ..... 62/6; 60/520

[56] References Cited

U.S. PATENT DOCUMENTS 4,090,859 5/1978 Hanson ..... 62/6

4,092,833 6/1978 Durenec ..... 62/6

4,277,947 7/1981 Durenec ..... 62/6

*Primary Examiner*—Ronald C. Capossela

*Attorney, Agent, or Firm*—Robert P. Gibson; Milton W. Lee; Max L. Harwell

[57] ABSTRACT

A dual pneumatic volume means in the ambient end of a free displacer cyrogenic cooler to provide strong pneumatic braking and dwell times of the displacer movement at both the top dead center and bottom dead center of the displacer waveform. A second pneumatic piston is positioned between the end of the cooler housing and extends into the first pneumatic piston attached to the displacer to form a pneumatic spring volume within the first piston to accomplish the strong pneumatic braking.

9 Claims, 4 Drawing Figures

DUAL PNEUMATIC VOLUME FOR CRYOGENIC COOLER

The invention described herein may be manufactured, used, and licensed by the U.S. Government for governmental purposes without the payment of any royalties thereon.

BACKGROUND OF THE INVENTION

1. Field of the Invention

The invention is in the field of remotely driven free displacer cyrogenic coolers based upon the balancing force at a frictional seal between an ambient temperature volume and a working fluid volume.

2. Description of the Prior Art

Generally, the ambient temperature volume of a cyrogenic cooler is comprised of one pneumatic volume which influences the movement of the free displacer according to the compressed state of the gas in the pneumatic volume, which acts against the sinusoidal pressure waves in the working fluid. The free displacer therefore follows a sinusoidal oscillatory wave pattern in which the pneumatic volume essentially does not alter the displacer waveform but only acts to restore the displacer back to its position with some slight phase shift while still supporting the sinusoidal movement thereof. The present dual pneumatic volume means alters the displacer movement by causing dwell times at both the top dead center (TDC) and bottom dead center (BDC) of the displacer movement waveform.

SUMMARY OF THE INVENTION

The dual pneumatic volume means of the present invention is located in the ambient temperature end of an enclosed cooler housing of a cooler, such as a pneumatically driven split cycle cryogenic cooler, to cushion impact and provide dwell times at the TDC and BDC positions of the displacer movement, and to restore a positive return of the displacer from these positions. The dual pneumatic volume means is preferably comprised of a first pneumatic piston which is rigidly attached by way of a self aligning joint to a free displacer forming an integral part thereof and which extends through a passageway of said cooler housing into a pneumatic bounce volume at the ambient temperature end of the cooler and a second pneumatic piston extending between the end of the pneumatic bounce volume and moveably positioned within the first pneumatic piston to form a pneumatic spring volume therein. The pneumatic spring volume provides a second active force in limiting the motion of the first pneumatic piston, and therefore the integrally connected displacer attached thereto. A mechanical spring means, such as a coil spring, may also be included in the pneumatic spring volume to further limit movement of the displacer especially at the TDC. The mechanical spring means K factor will however be designed for only one charge pressure. The first and second pneumatic pistons and/or the first pneumatic piston and the cooler housing passageway may have mating slots and keys or rounded grooves and spring loaded ball bearings on opposite sides thereof to provide some twisting motion to accommodate for thermal shock of the regenerator-displacer caused by the huge changes in temperatures from the cold end to the ambient temperature side. The mating surfaces are however preferably between the first and second pneumatic pistons positioned in an angular spiral with the first pneumatic piston having labyrinth seals around its outer portion at the passageway to provide a metal-to-metal calibrated leak seal which allows some slight leakage of the working fluid for most efficient operation. The labyrinth seals provide an effective frictional seal upon which the balanced force between the working fluid volume and the dual pneumatic volume means act. The working fluid may be helium or hydrogen.

DETAILED DESCRIPTION OF THE PREFERRED EMBODIMENT

Figure 1:
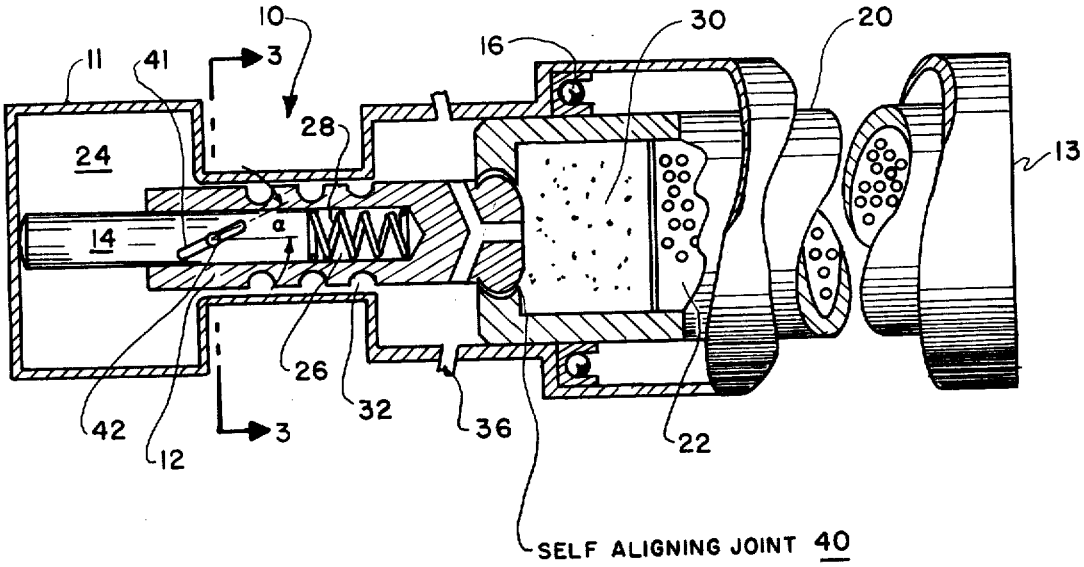
FIG. 1 illustrates a side cut-away view of a typical split cycle cyrogenic cooler employing the present invention.
Figure 2:
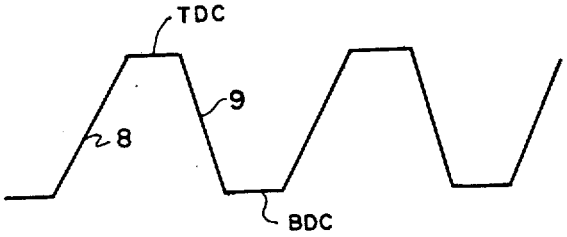
FIG. 2 shows typical displacer waveforms from practice of the present invention.

Before detailed reference to FIG. 1, it should be noted that the displacer waveforms as shown by FIG. 2 are representatively not concentric, i.e. it takes longer for the compression stroke, represent by numeral 8, to reach the flattened TDC than for the expansion stroke, represented by numeral 9, to reach the flattened BDC. Efficiency is greatly improved however in the present dual pneumatic volume means.

Refer to FIG. 1 in which a cooler 10 is shown comprised of a cold end 13 and an ambient temperature end 11 with a passageway therebetween in an enclosed cooler housing. A first pneumatic piston 12 is rigidly connected to regenerator-displacer by a self aligning joint 40 which allows some lateral movement therebetween wherein twisting or spiral motion of said first pneumatic piston 12 accommodates the thermal stresses set up in the regenerator-displacer 20 at the wide temperature differences from cold end 13 to the ambient temperature end. Piston 12 and displacer however reciprocate as one unit when a working fluid enters displacer 20 by way of a plurality of inlet ports 36 from a remote compressor and feed lines (not shown). The working fluid easily passes through an end plug 30, preferably made of sintered metal balls having about 40% porosity and maybe a screen mesh at the end, and the regenerator matrix 22, which may be a plurality of separate metal balls. Matrix 22 is contiguous with end plug 30 and may be enclosed at cold end 13 by another similar end plug. Displacer 20 moves within leap seal 16 in the conventional manner according to working fluid pressures developed across the displacer. Leap seal 16 may be made of fluorocarbon, carbon graphite, Rulon or Rulon J4 as examples. Labyrinth seals around piston 12 are represented by numeral 32.

Figure 3A:
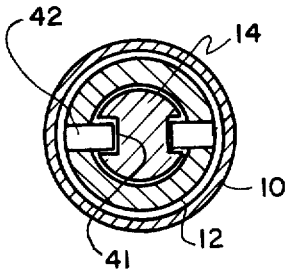
FIGS. 3A and 3B illustrate mating means for the two pneumatic pistons.
Figure 3B:
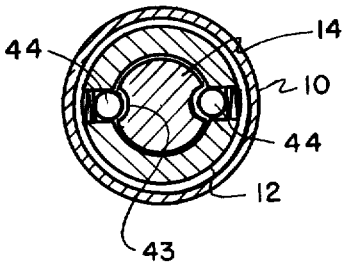

Piston 12 extends part way into pneumatic bounce volume 24. A second pneumatic piston 14 is moveably positioned within first pneumatic piston 12 and extends to the end of volume 24. First and second pistons 12 and 14 may move relative to each other by mating means such as shown by FIGS. 3A and 3B representing section 3—3 from FIG. 1. FIG. 3A shows a slot 41 within piston 14 which is mated with a key 42 extending out from piston 12. FIG. 3B shows another mating means which is comprised of rounded grooves 43 in piston 14 mated to spring loaded ball bearings 44 set in piston 12. Both pistons 12 and 14 are preferably made of Rulon. The slot or groove are preferably twisted as shown in FIG. 1 representing slot 41 at an angular spiral $\alpha$ to provide relative spiraling between the two pistons. A pneumatic spring volume 26 is formed within piston 12 enclosed by the end of piston 14 in which volume 26 is simultaneously compressed or expanded with that of volume 24. A mechanical spring means 28 in volume 26 provides further pneumatic braking for displacer 20.

In operation, the pneumatic spring volume 26 provides a positive counteraction to motion of the displacer as the displacer approaches TDC and BDC. The size of volume 26 should be large enough in which a near vacuum created therein as the displacer approaches BDC holds both pressures across labyrinth seals 32 in equilibrium to flatten the BDC of the displacer movement and to flatten the TDC of displacer movement by a strong internal compressive pressure against piston 12, and especially with the aid of the mechanical spring means.

While only one preferred embodiment has been described it is to be understood that other variations may be made while remaining within the spirit and scope of the invention which is limited only by the following claims.

I claim:

1. A means for controlling the movement of a free displacer in a cryogenic cooler comprising:

an enclosed cooler housing having a regenerator-displacer with a first pneumatic piston rigidly attached thereto which extends through a passageway into an ambient temperature end of said cooler housing and a regenerator-matrix within said free displacer at a cold end of said cooler housing wherein the mating surfaces between said first pneumatic piston and said passageway forms an effective frictional seal between said ambient temperature end and said cold end wherein a working fluid in said cold end has alternating pressure waves applied thereto from a remote compressor to move said free displacer reciprocally within said enclosed cooler housing; and a dual pneumatic volume means in said ambient temperature end to limit movement of said free displacer at its extreme ends of reciprocal movement to provide pneumatic braking in the form of flat displacer waveform dwell times, said dual pneumatic volume means comprised of a pneumatic bounce volume into which said first pneumatic piston extends and a pneumatic spring volume formed inside said first pneumatic piston between a second pneumatic piston moveably positioned along an inside surface of said first pneumatic piston and extending to said enclosed cooler housing at the end of said pneumatic bounce volume wherein compressin within said pneumatic spring volume during the compression cycle of said working fluid and expansion within said pneumatic spring volume during the expansion cycle of said working fluid causes pneumatic braking of said free displacer at the top dead center and bottom dead center to provide flat displacer waveforms.

2. A means as set forth in claim 1 wherein said first pneumatic piston has labyrinth seals around its outer portion in slidable contact with said passageway to prevent working fluid leakage and to provide a balance force at said effective frictional seal between said working volume and said dual pneumatic volume means.

3. A means as set forth in claim 2 wherein said pneumatic spring volume has a mechanical spring means therein to provide further pneumatic braking of said free displacer.

4. A means as set forth in claim 3 wherein said mechanical spring means is a coil spring.

5. A means as set forth in claim 4 wherein the moveable surfaces between first and second pneumatic pistons are comprised of mating slots and keys on opposite surfaces.

6. A means as set forth in claim 5 wherein said working fluid is helium.

7. A means as set forth in claim 5 wherein said working fluid is hydrogen.

8. A means as set forth in claim 4 wherein the moveable surfaces between first and second pneumatic pistons are comprised of mating rounded grooves and spring loaded ball bearings on opposite surfaces.

9. A means as set forth in either claim 5 or claim 8 wherein said first pneumatic piston and said regeneraor-displacer are rigidly attached to each other by way of a self aligning joint with some lateral movement therebetween to allow twisting motion of said first pneumatic piston about said mating slots and keys or said mating rounded grooves and spring loaded ball bearings to accommodate for thermal shock of said regenerator-displacer during cooling operation.

* * * * *